US009784101B2

(12) United States Patent
Jackson et al.

(10) Patent No.: US 9,784,101 B2
(45) Date of Patent: Oct. 10, 2017

(54) ESTIMATION OF MUD FILTRATE SPECTRA AND USE IN FLUID ANALYSIS

(71) Applicant: Schlumberger Technology Corporation, Sugar Land, TX (US)

(72) Inventors: Richard Jackson, Norwich (GB); Ankit Agarwal, Liluah (IN); Adriaan Gisolf, Houston, TX (US); Ilaria De Santo, Paris (FR); Youxiang Zuo, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 692 days.

(21) Appl. No.: 14/248,528

(22) Filed: Apr. 9, 2014

(65) Prior Publication Data

US 2015/0292324 A1 Oct. 15, 2015

(51) Int. Cl.
*E21B 49/08* (2006.01)
*E21B 49/10* (2006.01)

(52) U.S. Cl.
CPC ..... *E21B 49/08* (2013.01); *E21B 49/10* (2013.01)

(58) Field of Classification Search
CPC .... E21B 49/10; E21B 49/08; E21B 2049/085; E21B 49/087
See application file for complete search history.

(56) References Cited

U.S. PATENT DOCUMENTS

| | | | | |
|---|---|---|---|---|
| 7,280,214 | B2 | 10/2007 | DiFoggio et al. | |
| 7,484,563 | B2 | 2/2009 | Zazovsky et al. | |
| 7,782,460 | B2 | 8/2010 | DiFoggio et al. | |
| 8,024,125 | B2 | 9/2011 | Hsu et al. | |
| 8,434,356 | B2 * | 5/2013 | Hsu | E21B 47/102 166/250.01 |
| 8,434,357 | B2 | 5/2013 | Hsu et al. | |
| 2007/0079962 | A1 * | 4/2007 | Zazovsky | E21B 49/008 166/264 |

(Continued)

OTHER PUBLICATIONS

Mullins et al. "Real-Time Determination of Filtrate Contamination During Openhole Wireline Sampling by Optical Spectroscopy", SPE Paper 63071, prepared for presentation at 2000 SPE Annual Technical Conference & Exhibition in Dallas, TX, Oct. 1-4, 2000, pp. 1-13.

(Continued)

*Primary Examiner* — Michael Wills, III
(74) *Attorney, Agent, or Firm* — Michael Dae

(57) ABSTRACT

A method for using an optical spectrum of mud filtrate for analysis of fluid drawn from a formation is provided. The method includes performing downhole fluid analysis of formation fluid drawn at a wellbore measurement station and determining an optical spectrum of mud filtrate in the formation fluid drawn at the wellbore measurement station. The method also includes performing downhole fluid analysis of formation fluid drawn at an additional wellbore measurement station, and performing the downhole fluid analysis of formation fluid drawn at the additional wellbore measurement station includes using the determined optical spectrum of the mud filtrate in the formation fluid previously drawn at the wellbore measurement station. Additional methods, systems, and devices are also disclosed.

10 Claims, 8 Drawing Sheets

(56) References Cited

U.S. PATENT DOCUMENTS

| | | | | |
|---|---|---|---|---|
| 2011/0042070 | A1* | 2/2011 | Hsu | E21B 47/102 166/250.01 |
| 2011/0088895 | A1* | 4/2011 | Pop | E21B 7/04 166/254.2 |
| 2011/0088949 | A1 | 4/2011 | Zuo et al. | |
| 2011/0284219 | A1 | 11/2011 | Pomerantz et al. | |
| 2013/0071934 | A1* | 3/2013 | Indo | G01N 21/80 436/28 |
| 2013/0311099 | A1* | 11/2013 | Eyuboglu | E21B 49/08 702/11 |
| 2013/0340518 | A1 | 12/2013 | Jones et al. | |
| 2016/0003970 | A1* | 1/2016 | Simcock | E21B 47/00 356/440 |
| 2016/0084718 | A1* | 3/2016 | Teale | E21B 47/065 374/161 |

OTHER PUBLICATIONS

Mullins et al. "Real-Time Quantification of OBM filtrate contamination during Openhole Wireline Sampling by Optical Spectroscopy", presented at SPWLA Annual Logging Symposium, Jun. 4-7, 2000, pp. 1-10.

* cited by examiner

ESTIMATION OF MUD FILTRATE SPECTRA AND USE IN FLUID ANALYSIS

BACKGROUND

Wells are generally drilled into subsurface rocks to access fluids, such as hydrocarbons, stored in subterranean formations. The formations penetrated by a well can be evaluated for various purposes, including for identifying hydrocarbon reservoirs within the formations. Formation evaluation may involve drawing fluid from a formation into a downhole tool. In some instances, downhole fluid analysis (DFA) is used to test the fluid while it remains in the well. Such analysis can be used to provide information on certain fluid properties in real time without the delay associated with returning fluid samples to the surface. Information obtained through downhole fluid analysis can also be used as inputs to various modeling and simulation techniques to estimate properties or behavior of petroleum fluid in a reservoir.

Fluids drawn from formations for evaluation can include fluids occurring naturally in the formations, such as hydrocarbons, as well as other fluids. These other fluids can include mud filtrate (the liquid portion of drilling mud). During drilling and testing operations, wells are often kept in an overbalance state with drilling mud to inhibit formation fluids from flowing into the wells. In this state, mud filtrate invades formations from the wellbores and solid particulates in the drilling mud form mudcake along the wellbores. The presence of mud filtrate in a fluid sampled from a formation can impact the efficiency and accuracy of analysis of the sampled fluid.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment of the present disclosure, a method includes performing downhole fluid analysis of formation fluid drawn at a wellbore measurement station and determining a characteristic of mud filtrate in that formation fluid. The method also includes performing downhole fluid analysis of formation fluid drawn at an additional wellbore measurement station. This downhole fluid analysis of formation fluid drawn at the additional wellbore measurement station uses the determined characteristic of the mud filtrate in the formation fluid previously drawn at the other wellbore measurement station.

In another embodiment, a method includes measuring sets of optical densities of formation fluid to multiple wavelengths of electromagnetic radiation with a downhole tool positioned in a wellbore. The downhole tool is calibrated in the wellbore based on the sets of measured optical densities. Further, the method includes measuring an additional set of optical densities of formation fluid to multiple wavelengths of electromagnetic radiation using the calibrated downhole tool.

In a further embodiment, an apparatus includes a downhole sampling tool and a controller. The downhole sampling tool includes a downhole fluid analysis module for determining parameters of sampled fluids. Further, the controller can determine a characteristic of mud filtrate in fluid sampled at a station within a wellbore through downhole fluid analysis and use the determined characteristic in subsequent downhole fluid analysis.

Various refinements of the features noted above may exist in relation to various aspects of the present embodiments. Further features may also be incorporated in these various aspects as well. These refinements and additional features may exist individually or in any combination. For instance, various features discussed below in relation to the illustrated embodiments may be incorporated into any of the above-described aspects of the present disclosure alone or in any combination. Again, the brief summary presented above is intended just to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Figure 1:
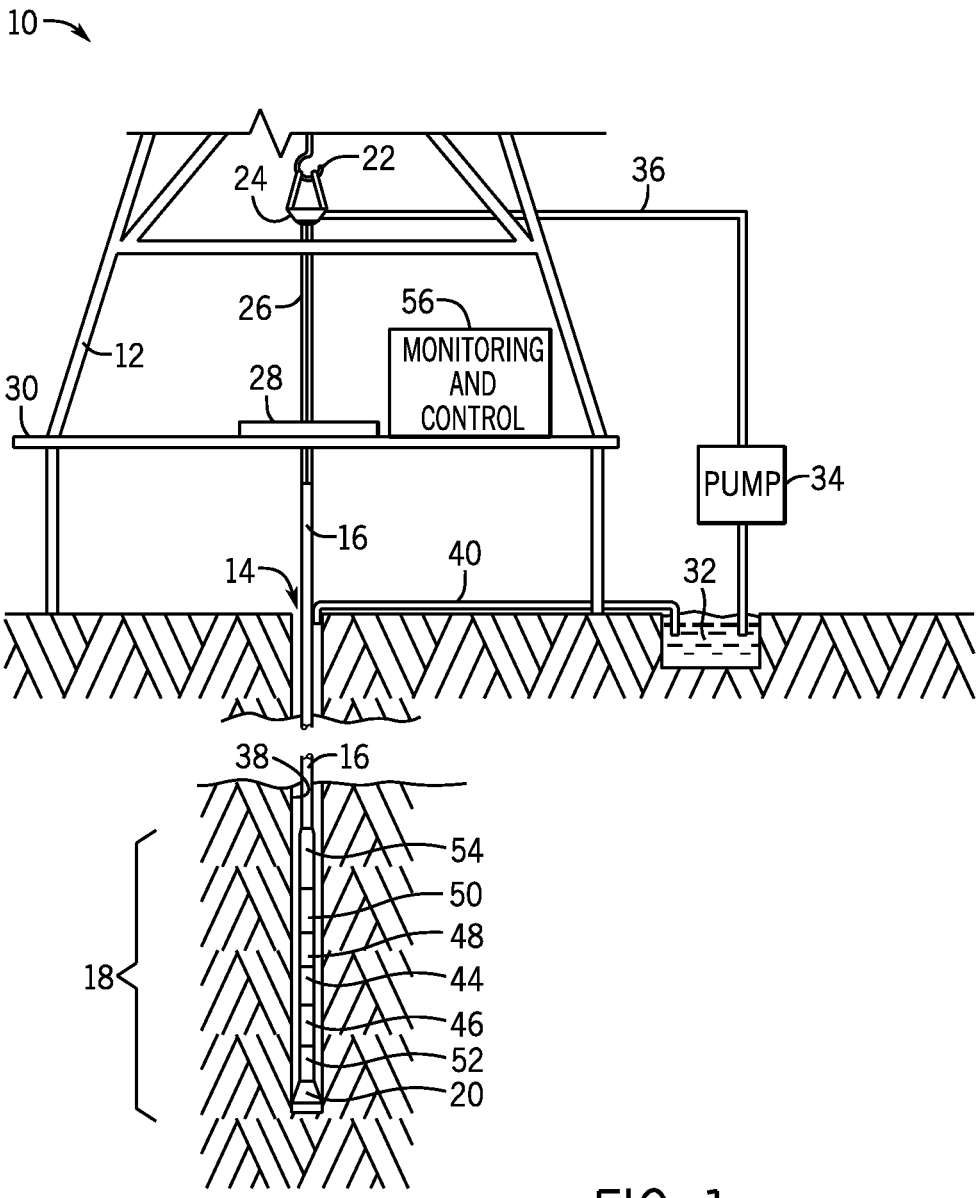
FIG. 1 generally depicts a drilling system having a fluid sampling tool in a drill string in accordance with one embodiment of the present disclosure.

It is to be understood that the present disclosure provides many different embodiments, or examples, for implementing different features of various embodiments. Specific examples of components and arrangements are described below for purposes of explanation and to simplify the present disclosure. These are, of course, merely examples and are not intended to be limiting.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not mandate any particular orientation of the components.

The present disclosure generally relates to formation testing and analysis of fluids drawn from formations. More particularly, some embodiments of the present technique include performing downhole fluid analysis of fluid drawn from a formation, determining properties of mud filtrate in the drawn fluid, and using such properties to inform further downhole fluid analysis. Challenges in obtaining representative formation fluid samples during formation testing include the contamination of formation fluids with miscible drilling fluids and the invasion of drilling mud filtrate into the formation adjacent to the wellbore during drilling. By way of example, oil-based muds are typically mixed using different additives based on expected formation properties and drilling specifications. In the drilling environment, oil-based muds are exposed to formation cuttings and may be partially miscible with some formation fluids. During and soon after drilling, these processes can result in properties (e.g., optical properties) of the mud filtrate being different from those of the initial base oil used to prepare the drilling mud.

Further, in an overbalance drilling environment, mud filtrate invades the formation from the wellbore. This invasion process continues to the formation of a mudcake, and it may diminish or slow depending on mudcake properties and other factors. The diameter of invasion depends on formation static and dynamic properties along with the activities carried out in the wellbore prior to logging and to formation testing and sampling operations. Data acquired from wireline logs will tend to be affected by mud invasion. During formation fluid sampling, the early part of the formation test will be dominated by drilling mud filtrate. As the formation test continues and production cleanup progresses, the proportion of formation fluid will tend to increase. Those skilled in the art will appreciate the desirability to identify formation fluid that is sufficiently clean for accurate characterization of the formation fluids and for retaining samples to be carried to the surface.

Variation in formation fluid properties and in mixtures of formation fluid and drilling fluids during formation testing and sampling operations can be detected through optical spectroscopy and measurements of optical density at different wavelengths. Characterizing reservoir fluids and contamination from drilling muds and mud filtrate can be based on downhole fluid analysis measurements, such as optical density, fluid density, compressibility, composition, gas-to-oil ratio (GOR), viscosity, fluorescence intensity, and pressure and temperature. The optical spectra of oil-based mud filtrate and the spectra for the formation fluid are often unknown, however.

In accordance with certain embodiments of the present technique, characteristics of mud filtrate and of formation fluid can be estimated at in-situ conditions during the progress of formation testing and fluid sampling operations. In some embodiments, for example, the optical spectra of mud filtrate are identified from the responses measured with a fluid analyzer of a downhole tool while fluids are being pumped and withdrawn from reservoir formations. The estimated mud filtrate optical spectra (or other mud filtrate characteristics, such as density, viscosity, compressibility, or composition) can be used in subsequent analysis, such as contamination analysis and hydrocarbon identification.

As noted above and discussed more fully below, downhole fluid analysis can be used to determine properties of mud filtrate in fluid drawn from a formation, and these determined properties can be used to inform later analysis of fluid drawn from a formation. Such downhole fluid analysis can be performed with downhole tools of various wellsite systems, such as drilling systems and wireline systems. Embodiments of two such systems are depicted in FIGS. 1 and 2 by way of example.

Figure 2:
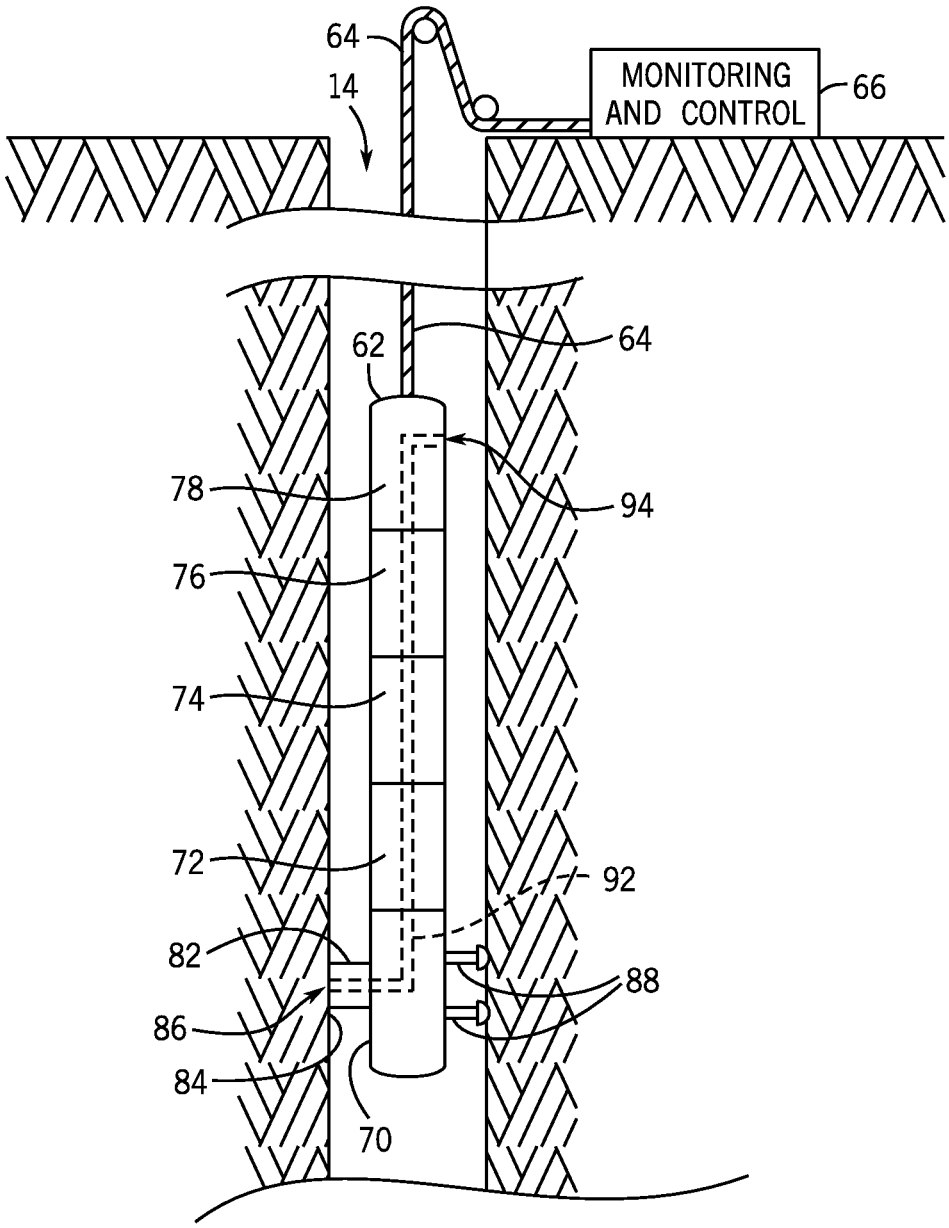
FIG. 2 generally depicts a fluid sampling tool deployed within a well on a wireline in accordance with one embodiment.

More specifically, a drilling system 10 is depicted in FIG. 1 in accordance with one embodiment. While certain elements of the drilling system 10 are depicted in this figure and generally discussed below, it will be appreciated that the drilling system 10 may include other components in addition to, or in place of, those presently illustrated and discussed. As depicted, the system 10 includes a drilling rig 12 positioned over a well 14. Although depicted as an onshore drilling system 10, it is noted that the drilling system could instead be an offshore drilling system. The drilling rig 12 supports a drill string 16 that includes a bottomhole assembly 18 having a drill bit 20. The drilling rig 12 can rotate the drill string 16 (and its drill bit 20) to drill the well 14.

The drill string 16 is suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 is coupled to the drill string 16, and the swivel 24 allows the kelly 26 and the drill string 16 to rotate with respect to the hook 22. In the presently illustrated embodiment, a rotary table 28 on a drill floor 30 of the drilling rig 12 is constructed to grip and turn the kelly 26 to drive rotation of the drill string 16 to drill the well 14. In other embodiments, however, a top drive system could instead be used to drive rotation of the drill string 16.

During operation, drill cuttings or other debris may collect near the bottom of the well 14. Drilling fluid 32 (e.g., oil-based mud or water-based mud) can be circulated through the well 14 to remove this debris. The drilling fluid 32 may also clean and cool the drill bit 20 and provide positive pressure within the well 14 to inhibit formation fluids from entering the wellbore. In FIG. 1, the drilling fluid 32 is a drilling mud circulated through the well 14 by a pump 34. The drilling fluid 32 is pumped from a mud pit (or some other reservoir, such as a mud tank) into the drill string 16 through a supply conduit 36, the swivel 24, and the kelly 26. The drilling fluid 32 exits near the bottom of the drill string 16 (e.g., at the drill bit 20) and returns to the surface through the annulus 38 between the wellbore and the drill string 16. A return conduit 40 transmits the returning drilling fluid 32 away from the well 14. In some embodiments, the returning drilling fluid 32 is cleansed (e.g., via one or more shale shakers, desanders, or desilters) and reused in the well 14.

In addition to the drill bit 20, the bottomhole assembly 18 also includes various instruments that measure information of interest within the well 14. For example, as depicted in FIG. 1, the bottomhole assembly 18 includes a logging-while-drilling (LWD) module 44 and a measurement-while-drilling (MWD) module 46. Both modules include sensors, housed in drill collars, that collect data and enable the creation of measurement logs in real time during a drilling operation. The modules could also include memory devices for storing the measured data. The LWD module 44 includes sensors that measure various characteristics of the rock and formation fluid properties within the well 14. Data collected by the LWD module 44 could include measurements of gamma rays, resistivity, neutron porosity, formation density, sound waves, optical density, and the like. The MWD module 46 includes sensors that measure various characteristics of the bottomhole assembly 18 and the wellbore, such as orientation (azimuth and inclination) of the drill bit 20, torque, shock and vibration, the weight on the drill bit 20, and downhole temperature and pressure. The data collected by the MWD module 46 can be used to control drilling operations. The bottomhole assembly 18 can also include one or more additional modules 48, which could be LWD modules, MWD modules, or some other modules. It is noted that the bottomhole assembly 18 is modular, and that the positions and presence of particular modules of the assembly could be changed as desired. Further, as discussed in greater detail below, one or more of the modules 44, 46, and 48 is or includes a fluid sampling tool configured to obtain a sample of a fluid from a subterranean formation and perform downhole fluid analysis to measure various properties of the sampled fluid.

The bottomhole assembly 18 can also include other modules. As depicted in FIG. 1 by way of example, such other modules include a power module 50, a steering module 52, and a communication module 54. In one embodiment, the power module 50 includes a generator (such as a turbine) driven by flow of drilling mud through the drill string 16. In other embodiments the power module 50 could also or instead include other forms of power storage or generation, such as batteries or fuel cells. The steering module 52 may include a rotary-steerable system that facilitates directional drilling of the well 14. The communication module 54 enables communication of data (e.g., data collected by the LWD module 44 and the MWD module 46) between the bottomhole assembly 18 and the surface. In one embodiment, the communication module 54 communicates via mud pulse telemetry, in which the communication module 54 uses the drilling fluid 32 in the drill string as a propagation medium for a pressure wave encoding the data to be transmitted.

The drilling system 10 also includes a monitoring and control system 56. The monitoring and control system 56 can include one or more computer systems that enable monitoring and control of various components of the drilling system 10. The monitoring and control system 56 can also receive data from the bottomhole assembly 18 (e.g., data from the LWD module 44, the MWD module 46, and the additional module 48) for processing and for communication to an operator, to name just two examples. While depicted on the drill floor 30 in FIG. 1, it is noted that the monitoring and control system 56 could be positioned elsewhere, and that the system 56 could be a distributed system with elements provided at different places near or remote from the well 14.

Another example of using a downhole tool for formation testing within the well 14 is depicted in FIG. 2. In this embodiment, a fluid sampling tool 62 is suspended within drilling mud in the well 14 with a cable 64. The cable 64 may be a wireline cable with at least one conductor that enables data transmission between the fluid sampling tool 62 and a monitoring and control system 66. The cable 64 may be raised and lowered within the well 14 in any suitable manner. For instance, the cable 64 can be reeled from a drum in a service truck, which may be a logging truck having the monitoring and control system 66. The monitoring and control system 66 controls movement of the fluid sampling tool 62 within the well 14 and receives data from the fluid sampling tool 62. In a similar fashion to the monitoring and control system 56 of FIG. 1, the monitoring and control system 66 may include one or more computer systems or devices and may be a distributed computing system. The received data can be stored, communicated to an operator, or processed, for instance. While the fluid sampling tool 62 is here depicted as being deployed by way of a wireline, in some embodiments the fluid sampling tool 62 (or at least its functionality) is incorporated into or as one or more modules of the bottomhole assembly 18, such as the LWD module 44 or the additional module 48.

The fluid sampling tool 62 can take various forms. While it is depicted in FIG. 2 as having a body including a probe module 70, a fluid analysis module 72, a pump module 74, a power module 76, and a fluid storage module 78, the fluid sampling tool 62 may include different modules in other embodiments. The probe module 70 includes a probe 82 that may be extended (e.g., hydraulically driven) and pressed into engagement against a wall 84 of the well 14 to draw fluid from a formation into the fluid sampling tool 62 through an intake 86. As depicted, the probe module 70 also includes one or more setting pistons 88 that may be extended outwardly to engage the wall 84 and push the end face of the probe 82 against another portion of the wall 84. In some embodiments, the probe 82 includes a sealing element or packer that isolates the intake 86 from the rest of the wellbore. In other embodiments the fluid sampling tool 62 could include one or more inflatable packers that can be extended from the body of the fluid sampling tool 62 to circumferentially engage the wall 84 and isolate a region of the well 14 near the intake 86 from the rest of the wellbore. In such embodiments, the extendable probe 82 and setting pistons 88 could be omitted and the intake 86 could be provided in the body of the fluid sampling tool 62, such as in the body of a packer module housing an extendable packer.

The pump module 74 draws the sampled formation fluid into the intake 86, through a flowline 92, and then either out into the wellbore through an outlet 94 or into a storage container (e.g., a bottle within fluid storage module 78) for transport back to the surface when the fluid sampling tool 62 is removed from the well 14. The fluid analysis module 72, which may also be referred to as the fluid analyzer 72, includes one or more sensors for measuring properties of the sampled formation fluid, such as the optical densities of the fluid for one or more wavelengths of electromagnetic radiation, and the power module 76 provides power to electronic components of the fluid sampling tool 62.

The drilling and wireline environments depicted in FIGS. 1 and 2 are examples of environments in which a fluid sampling tool may be used to facilitate analysis of a downhole fluid. The presently disclosed techniques, however, could be implemented in other environments as well. For instance, the fluid sampling tool 62 may be deployed in other manners, such as by a slickline, coiled tubing, or a pipe string.

Figure 3:
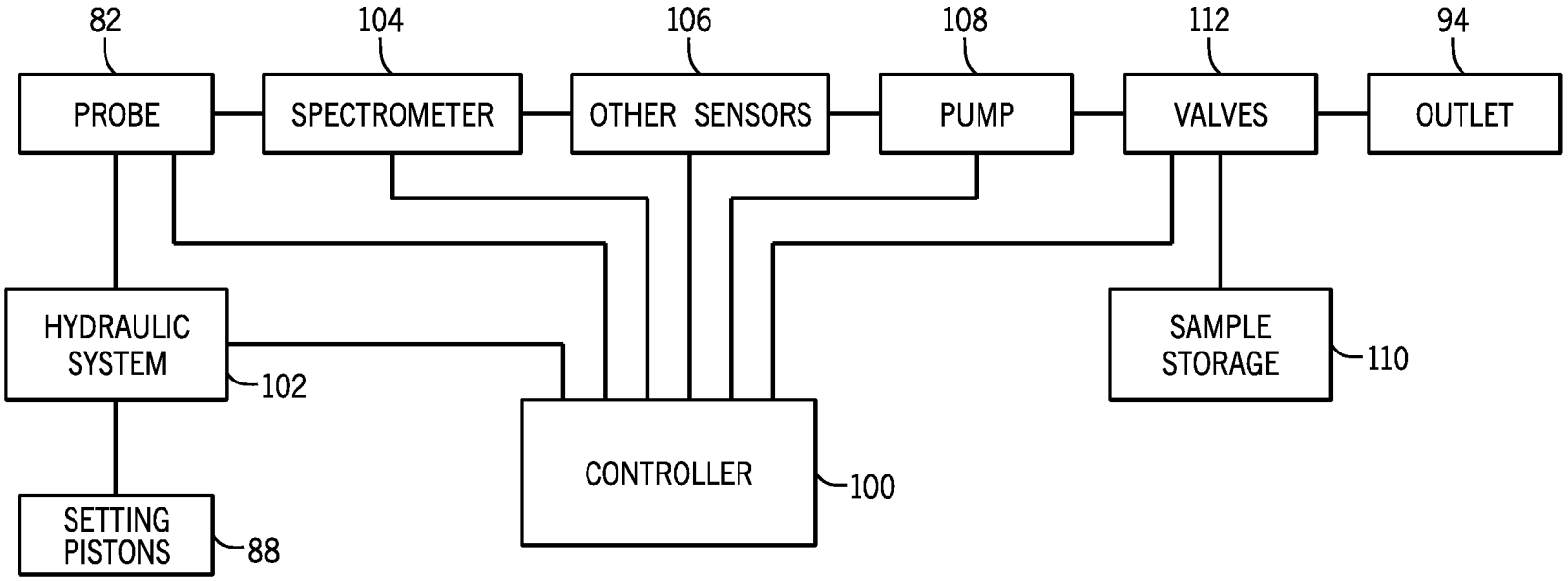
FIG. 3 is a block diagram of components of a fluid sampling tool operated by a controller in accordance with one embodiment.

Additional details as to the construction and operation of the fluid sampling tool 62 may be better understood through reference to FIG. 3. As shown in this figure, various components for carrying out functions of the fluid sampling tool 62 are connected to a controller 100. The various components include a hydraulic system 102 connected to the probe 82 and the setting pistons 88, a spectrometer 104 for measuring fluid optical properties, one or more other sensors 106, a pump 108, and valves 112 for diverting sampled fluid into storage devices 110 rather than venting it through the outlet 94.

In operation, the hydraulic system 102 extends the probe 82 and the setting pistons 88 to facilitate sampling of a formation fluid through the wall 84 of the well 14. It also retracts the probe 82 and the setting pistons 88 to facilitate subsequent movement of the fluid sampling tool 62 within the well. The spectrometer 104, which can be provided as part of the fluid analyzer 72, collects data about optical properties of the sampled formation fluid. Such measured optical properties can include optical densities (absorbance) of the sampled formation fluid at different wavelengths of electromagnetic radiation. Other sensors 106 can be provided in the fluid sampling tool 62 (e.g., as part of the probe module 70 or the fluid analyzer 72) to take additional measurements related to the sampled fluid. In various embodiments, these additional measurements could include reservoir pressure and temperature, fluid density, fluid viscosity, electrical resistivity, saturation pressure, and fluorescence, to name several examples. Other characteristics, such as gas-to-oil ratio or fluid composition, can also be determined using the downhole fluid analysis measurements.

Any suitable pump 108 may be provided in the pump module 74 to enable formation fluid to be drawn into and pumped through the flowline 92 in the manner discussed above. Storage devices 110 for formation fluid samples can include any suitable vessels (e.g., bottles) for retaining and transporting desired samples within the fluid sampling tool 62 to the surface. Both the storage devices 110 and the valves 112 may be provided as part of the fluid storage module 78.

In the embodiment depicted in FIG. 3, the controller 100 facilitates operation of the fluid sampling tool 62 by controlling various components. Specifically, the controller 100 directs operation (e.g., by sending command signals) of the hydraulic system 102 to extend and retract the probe 82 and the setting pistons 88 and of the pump 108 to draw formation fluid samples into and through the fluid sampling tool. The controller 100 also receives data from the spectrometer 104 and the other sensors 106. This data can be stored by the controller 100 or communicated to another system (e.g., the monitoring and control system 56 or 66) for analysis. In some embodiments, the controller 100 is itself capable of analyzing the data it receives from the spectrometer 104 and the other sensors 106. The controller 100 also operates the valves 112 to divert sampled fluids from the flowline 92 into the storage devices 110.

Figure 4:
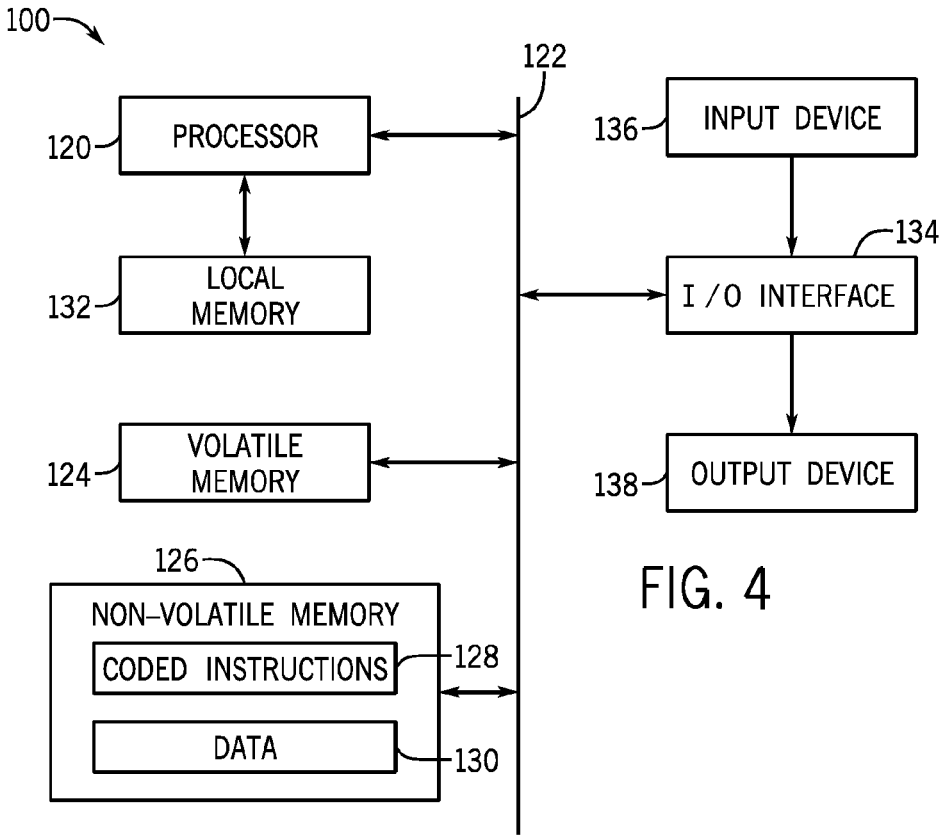
FIG. 4 is a block diagram of components in one example of the controller illustrated in FIG. 3.

The controller 100 in some embodiments is a processor-based system, an example of which is provided in FIG. 4. In this depicted embodiment, the controller 100 includes at least one processor 120 connected, by a bus 122, to volatile memory 124 (e.g., random-access memory) and non-volatile memory 126 (e.g., flash memory and a read-only memory (ROM)). Coded application instructions 128 (e.g., software that may be executed by the processor 120 to enable the control and analysis functionality described herein, including determining mud filtrate optical spectra and using the determined spectra for later analysis) and data 130 are stored in the non-volatile memory 126. For example, the application instructions 128 can be stored in a ROM and the data can be stored in a flash memory. The instructions 128 and the data 130 may be also be loaded into the volatile memory 124 (or in a local memory 132 of the processor) as desired, such as to reduce latency and increase operating efficiency of the controller 100.

An interface 134 of the controller 100 enables communication between the processor 120 and various input devices 136 and output devices 138. The interface 134 can include any suitable device that enables such communication, such as a modem or a serial port. In some embodiments, the input devices 136 include one or more sensing components of the fluid sampling tool 62 (e.g., the spectrometer 104) and the output devices 138 include displays, printers, and storage devices that allow output of data received or generated by the controller 100. Input devices 136 and output devices 138 may be provided as part of the controller 100, although in other embodiments such devices may be separately provided.

The controller 100 can be provided as part of the monitoring and control systems 56 or 66 outside of a well 14 to enable downhole fluid analysis of samples obtained by the fluid sampling tool 62. In such embodiments, data collected by the fluid sampling tool 62 can be transmitted from the well 14 to the surface for analysis by the controller 100. In some other embodiments, the controller 100 is instead provided within a downhole tool in the well 14, such as within the fluid sampling tool 62 or in another component of the bottomhole assembly 18, to enable downhole fluid analysis to be performed within the well 14. Further, the controller 100 may be a distributed system with some components located in a downhole tool and others provided elsewhere (e.g., at the surface of the wellsite). Whether provided within or outside the well 14, the controller 100 can receive data collected by the sensors within the fluid sampling tool 62 and process this data to determine one or more characteristics of interest for the sampled fluid. Examples of such characteristics include fluid type, gas-to-oil ratio, carbon dioxide content, water content, and contamination.

Some of the data collected by the fluid sampling tool 62 relates to optical properties (e.g., optical densities) of a sampled fluid measured by the spectrometer 104. To facilitate measurements, in some embodiments the spectrometer 104 may be arranged about the flowline 92 of the fluid sampling tool 62 in the manner generally depicted in FIG. 5. In this example, the spectrometer 104 includes an emitter 142 of electromagnetic radiation, such as a light source, and a detector 144 disposed about the flowline 92 in the fluid sampling tool 62. A light source provided as the emitter 142 can be any suitable light-emitting device, such as one or more light-emitting diodes or incandescent lamps. As used herein, the term "visible light" is intended to mean electromagnetic radiation within the visible spectrum, and the shorter term "light" is intended to include not just electromagnetic radiation within the visible spectrum, but also infrared and ultraviolet radiation.

Figure 5:
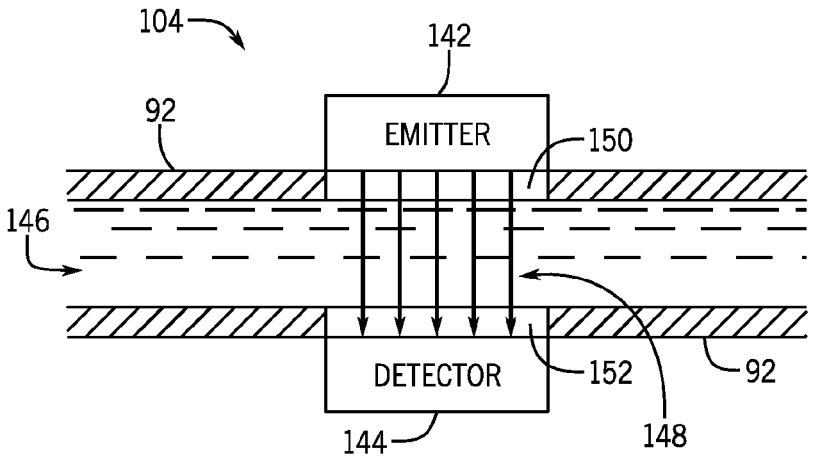
FIG. 5 generally depicts a spectrometer positioned about a flowline to enable measurement of an optical property of a fluid within the flowline in accordance with one embodiment.

In operation, a sampled formation fluid 146 within the flowline 92 is irradiated with electromagnetic radiation 148 (e.g., light) from the emitter 142. The electromagnetic radiation 148 includes radiation of any desired wavelengths within the electromagnetic spectrum. In some embodiments, the electromagnetic radiation 148 has a continuous spectrum within one or both of the visible range and the short- and near-infrared (SNIR) range of the electromagnetic spectrum, and the detector 144 filters or diffracts the received electromagnetic radiation 148. The detector 144 may include a plurality of detectors each assigned to separately measure light of a different wavelength. As depicted in FIG. 5, the flowline 92 includes windows 150 and 152 that isolate the emitter 142 and the detector 144 from the sampled formation fluid 146 while still permitting the electromagnetic radiation 148 to be transmitted and measured. As will be appreciated, some portion of the electromagnetic radiation 148 is absorbed by the sampled fluid 146, and the extent of such absorption varies for different wavelengths and sampled fluids. The optical density of the fluid 146 at one or more wavelengths may be determined based on data from the spectrometer 104 by comparing the amount of radiation emitted by the emitter 142 and the amount of that radiation received at detector 144. It will also be appreciated that the optical density (also referred to as the absorbance) of a fluid at a given wavelength is calculated as the base-ten logarithm of the ratio of electromagnetic radiation incident on the fluid to that transmitted through the fluid for the given wavelength.

The spectrometer 104 may include any suitable number of measurement channels for detecting different wavelengths, and may include a filter-array spectrometer or a grating spectrometer. For example, in some embodiments the spectrometer 104 is a filter-array absorption spectrometer having sixteen measurement channels. In other embodiments, the spectrometer 104 may have ten channels or twenty channels, and may be provided as a filter-array spectrometer or a grating spectrometer. The data obtained with the spectrometer 104 can be used to determine optical densities of sampled fluids, including optical spectra of mud filtrate in the sampled fluids.

The systems described above can be used to perform downhole fluid analysis of fluids drawn from formations. In at least some embodiments, a downhole tool (e.g., fluid sampling tool 62) can be used to sample formation fluids at one or more measurement stations within a wellbore (e.g., the well 14) and analyze the sampled fluids downhole (e.g., at each measurement station). More specifically, a formation fluid can be drawn into the fluid sampling tool and analyzed while the tool is positioned at a first depth (or station) within the well to determine formation fluid characteristics. The tool may then be moved successively to additional stations at different depths to sample and analyze fluids at each station. Such downhole fluid analysis enables in-situ determinations of numerous characteristics of the sampled fluids in real time, including optical densities, oil-based mud (OBM) contamination, and mass composition, for instance.

Figure 6:
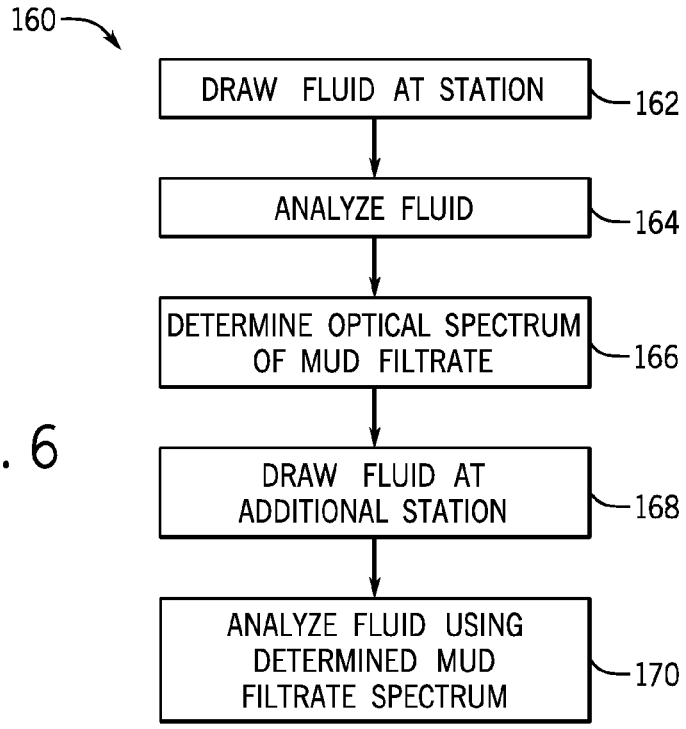
FIG. 6 is a flow chart for determining an optical spectrum of mud filtrate in fluid drawn from a measurement station within a well and using that determined mud filtrate optical spectrum for further fluid analysis in accordance with one embodiment.

In accordance with the present disclosure, these systems can be used to determine (e.g., estimate) characteristics of mud filtrate in fluids drawn from formations and use the determined mud filtrate characteristics to inform further analysis. In various embodiments, these characteristics can include optical spectrum, density, viscosity, compressibility, composition, and the like. Further, the mud filtrate characteristics can be determined in any suitable manner, such as through downhole fluid analysis. One example of a process for using a mud filtrate optical spectrum in this manner is generally represented by flow chart 160 in FIG. 6.

In this embodiment, a downhole tool can be moved to wellbore measurement stations at desired depths in a wellbore for formation testing. Once positioned at a desired measurement station within the wellbore, fluid may be drawn into the tool from the formation (block 162). This drawn fluid can be analyzed (block 164) in the tool, such as with the spectrometer 104 of the fluid analyzer 72, to determine an optical spectrum of mud filtrate within the fluid (block 166). In at least some instances, the drilling mud within the well is an oil-based mud and, accordingly, it is the optical spectrum of the oil-based mud filtrate within the fluid that is determined at block 166 in such instances. Any of the fluid optical spectra described herein can be embodied by a set of optical densities for the referenced fluid at multiple wavelengths of radiation. By way of example, the optical spectrum of the mud filtrate determined in block 166 can be embodied by a set of optical densities determined for the mud filtrate at multiple wavelengths of electromagnetic radiation (e.g., ranging across the visible and SNIR portions of the electromagnetic spectrum). Additionally, any discussion herein of determining or using optical spectra, such as in performing subsequent analysis, encompasses the determination or use of sets of optical densities embodying the optical spectra.

After determining the mud filtrate spectrum in block 166, fluid can be drawn at an additional wellbore measurement station (block 168) by the same downhole tool or by a different downhole tool. Moreover, while this additional measurement station can be located in the same well as the measurement station at which fluid was drawn in block 162, in at least one embodiment these measurement stations are in different wells. The mud filtrate optical spectrum determined at block 166 can be used to inform analysis of the fluid drawn at the additional station (block 170). For example, in one embodiment the wellbore measurement station at which fluid is drawn in block 162 is in a water zone of a well and the additional wellbore measurement station at which fluid is drawn in block 168 is in an oil zone of the well. Due to differences in the miscibility of the oil-based mud filtrate with water and oil, it may be easier in some instances to accurately determine the optical spectrum of oil-based mud filtrate spectrum from fluid drawn within a water zone, and this determined mud filtrate spectrum can then be used in analysis of fluid drawn within an oil zone of the well. The determined mud filtrate spectrum from the water zone can be used to inform oil-based mud filtrate contamination analysis of hydrocarbon fluid within the fluid drawn from the oil zone and identification of hydrocarbon fluid within the fluid drawn from the oil zone.

While two measurement stations have been described above with respect to flow chart 160 for explanatory purposes, it will be appreciated that, in practice, downhole fluid analysis may performed for formation fluids drawn at more measurement stations and optical spectra of mud filtrate in those fluids may be determined. In some instances, a mud filtrate optical spectrum for fluid at one measurement station is extrapolated from the mud filtrate optical spectra previously determined from fluids drawn at other measurement stations. The use of mud filtrate optical spectra determined from multiple stations generally reduces uncertainty in the extrapolated mud filtrate optical spectrum. The extrapolation can include filtering the determined mud filtrate optical spectra and then estimating the mud filtrate optical spectrum at the one measurement station from the filtered mud filtrate optical spectra. As a quality check on the determined optical spectra, such filtering can include removing outliers (e.g., spectra with measurements falling outside an expected range of variation, such as measurements of optical density at a wavelength falling outside two or three standard deviations from the mean for the wavelength). These outliers may be removed with or without determining underlying causes of the excessive variance. Quality control may also or instead be provided by comparing a mud filtrate optical spectra measured at a particular station with mud filtrate optical spectra determined at previous stations to verify reliability of the measurement at that particular station. Further, a downhole tool could have multiple fluid analyzers for determining mud filtrate optical spectra and the measurements of the multiple fluid analyzers could be compared to one another for quality control. The filtering of the determined mud filtrate optical spectra can also include zoning of the determined spectra (e.g., returning just the mud filtrate optical spectra for a particular zone in a well).

Additionally, in some embodiments, multiple optical spectra can be determined for fluid drawn at a single station at different times. The drawn fluid can be a mixture of mud filtrate and other fluids (e.g., hydrocarbons), and the proportions of mud filtrate and the other fluids can change over time as fluid is drawn from the formation. With knowledge of the mud filtrate optical spectrum, these optical spectra determined for fluid drawn at the station at different times can be used to extrapolate the optical spectra of fluid drawn at that station in the future. This can be used, for example, to predict the rate at which oil-based contamination in fluid drawn from the station will fall over time, facilitating decision-making on how long to keep the downhole tool at that station. In yet another embodiment, the mud filtrate optical spectra (or other characteristics) determined from formation fluid drawn in one well can be used to inform subsequent downhole fluid analysis in another well (e.g., in the case of both wells using drilling mud that is the same, is provided from the same source, or is similar in composition). Also, in at least some instances (e.g., when pumping fluids near an oil-water contact of a reservoir), mud filtrate characteristics can be used to identify whether oil or mud filtrate is being pumped from a formation.

Figure 7:
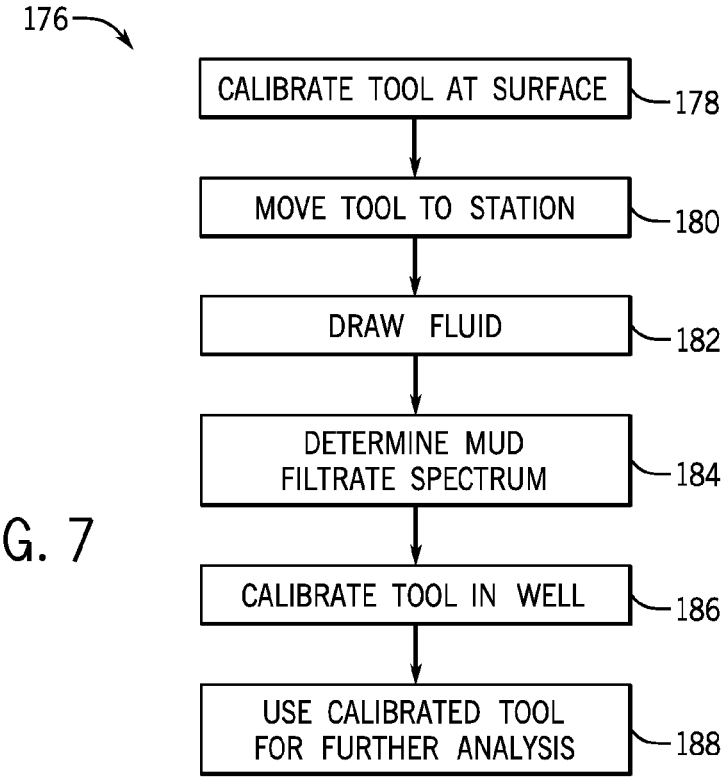
FIG. 7 is a flow chart for calibrating an analysis tool based on a determined mud filtrate spectrum and using the calibrated tool for additional fluid analysis in accordance with one embodiment.
Figure 8:
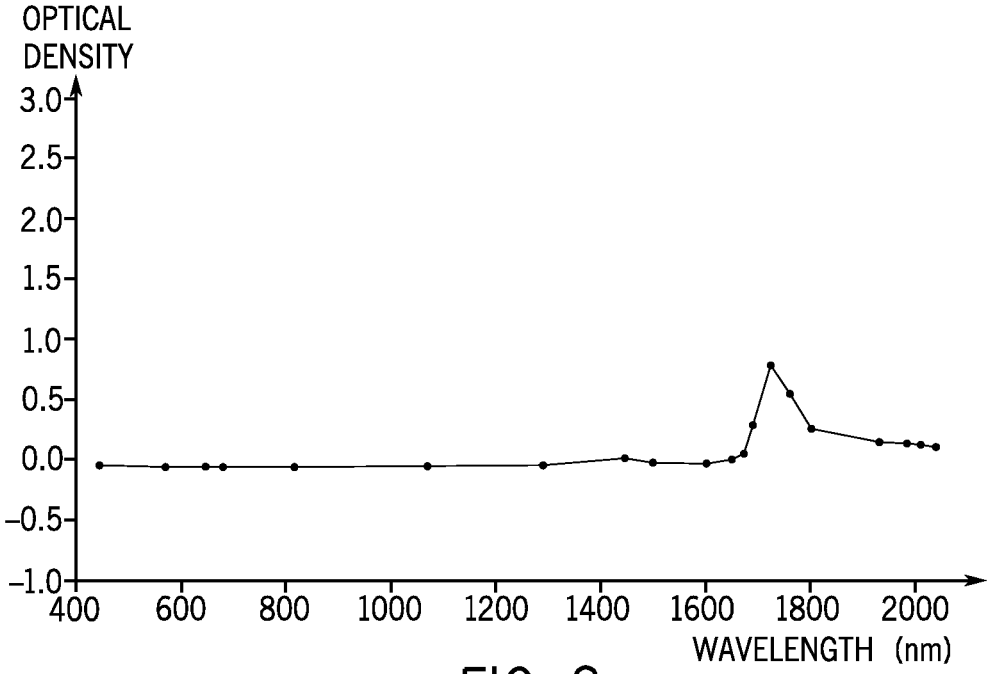
FIG. 8 is a graph showing an optical spectrum of a hydraulic oil used for a surface calibration of an optical fluid analyzer in accordance with one embodiment.

In certain embodiments, the use of the one or more determined mud filtrate spectra in subsequent analysis is provided through calibration of one or more sensors within a downhole tool (e.g., calibrating the spectrometer 104 of the fluid analyzer 72) based on the one or more determined mud filtrate spectra. One example of such an embodiment is a process generally represented by flow chart 176 in FIG. 7. In this embodiment, a downhole tool can be calibrated at the surface (block 178) before being lowered into a well. In some instances, this surface calibration can include routing a reference hydraulic fluid past the spectrometer 104 and measuring its optical spectrum. An example of this measured optical spectrum is depicted in FIG. 8. As shown in this graph, the measured optical spectrum includes data points of optical density for twenty wavelengths, which can be measured by different channels of the spectrometer. While the spectrometer may have twenty channels in certain embodiments, it could have a different number of channels in other embodiments. The response of the downhole tool can then be calibrated such that one or more measured data points of the optical spectrum of the reference hydraulic fluid read out at a desired optical density, such as zero.

After the surface calibration, the downhole tool can be lowered into a well to facilitate downhole fluid analysis. Inside the well, the tool can be moved to a measurement station (block 180) and used to draw fluid from a formation at the measurement station (block 182). Downhole fluid analysis can be performed on the drawn fluid and an optical spectrum of mud filtrate in the fluid can be determined (block 184).

Figure 9:
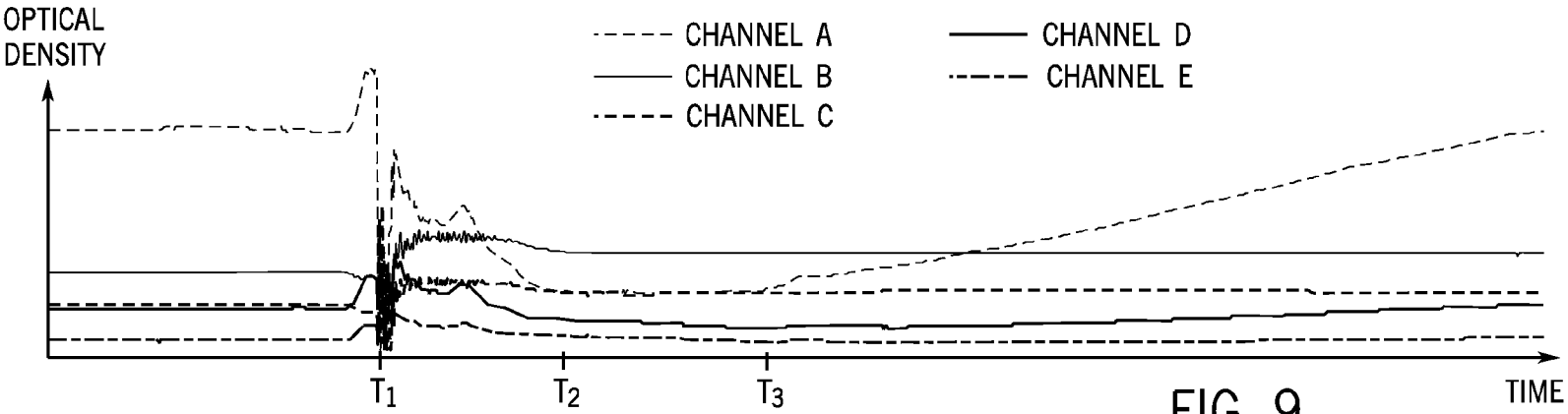
FIG. 9 is a graph depicting response of a fluid analyzer to electromagnetic radiation of different wavelengths transmitted through a fluid drawn from an oil zone of a formation in accordance with one embodiment.
Figure 10:
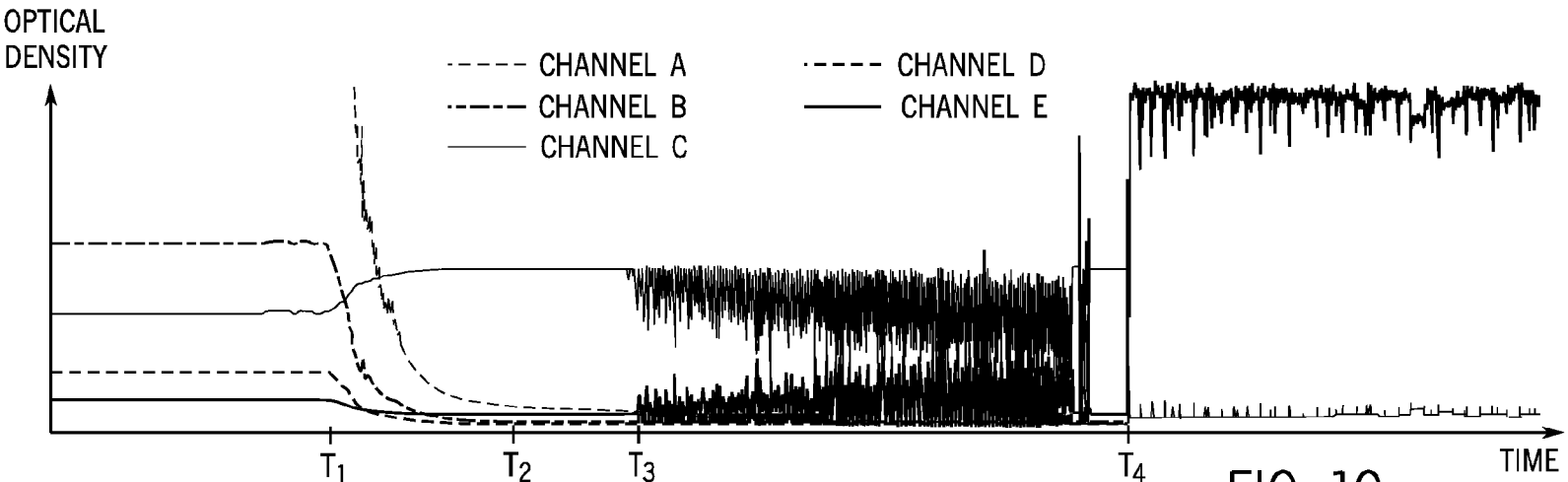
FIG. 10 is a graph depicting response of a fluid analyzer to electromagnetic radiation of different wavelengths transmitted through a fluid drawn from a water zone of a formation in accordance with one embodiment.

Determining the optical spectrum of mud filtrate within the fluid can include identifying a suitable time for accurately estimating the optical spectrum, such as in a period in which the concentration of mud filtrate in the drawn fluid is high and relatively stable. Such suitable times can be identified, for instance, based on measurements from one or more of the downhole fluid analysis sensors of the downhole tool. In some embodiments, measurements from a spectrometer of the downhole tool can be used in identifying a suitable time for estimating the mud filtrate optical spectrum. Two examples of this spectrometer response are depicted in the graphs of FIGS. 9 and 10. Particularly, the graph of FIG. 9 is an example of spectrometer response for fluid drawn from an oil zone of a well, while the graph of FIG. 10 is an example of spectrometer response for fluid drawn from a water zone of the well.

Referring first to FIG. 9, the optical densities of analyzed fluid for different wavelengths, as measured by five representative channels of the spectrometer (denoted as Channels A-E), are plotted as a function of time at a measurement station in an oil zone of a well. Initially, the spectrometer response measures optical densities for drilling mud or some other fluid present within the downhole tool before fluid is drawn from the formation at the measurement station. At about time $T_1$, the downhole tool begins to draw fluid from the formation. The spectrometer response can vary quickly between times $T_1$ and $T_2$ due to changes in the composition of the fluid analyzed within the tool. For example, the analyzed fluid in this time range can include a varying combination of drilling mud, solid particulates from the mudcake on the side of the formation within the well, and mud filtrate passing into the tool from the invaded zone. The response has largely settled by time $T_2$, corresponding to a high concentration of mud filtrate being routed through the tool and analyzed. At time $T_3$, the optical density measured by certain channels (i.e., Channels A and D in this example) begins to steadily increase, corresponding to an increasing concentration of formation oil in the fluid drawn into the tool. In some embodiments, the optical spectrum of the mud filtrate is estimated between times $T_2$ and $T_3$ (i.e., after the spectrometer response has settled and while the proportion of the mud filtrate in the fluid remains high and stable).

In FIG. 10, the optical densities of analyzed fluid for different wavelengths, as measured by five representative channels of the spectrometer (also denoted as Channels A-E in this figure), are plotted against time at a measurement station in a water zone of a well. The reference to the depicted response channels as Channels A-E in FIG. 10 is made for convenience; the Channels A-E of FIG. 10 may or may not correspond with those of FIG. 9. Similarly, times $T_1$, $T_2$, and $T_3$ in FIG. 10 may or may not correspond with times $T_1$, $T_2$, and $T_3$ in FIG. 9. The spectrometer response depicted in FIG. 10 is somewhat similar to that shown in FIG. 9. The downhole tool begins to draw fluid from the formation at time $T_1$, which is followed by settling of the responses of the different channels as the composition of the analyzed fluid shifts to a high concentration of mud filtrate from the invaded zone. This high concentration of mud filtrate from the invaded zone persists from time $T_2$ to time $T_3$, and the optical spectrum of the mud filtrate is measured in this range in at least some embodiments. From time $T_3$ to time $T_4$, the mud filtrate entering the downhole tool from the invaded zone is gradually replaced with water from the formation, causing the rapid variation shown for Channels C and E. After time $T_4$, the analyzed fluid is mostly water from the formation.

While a suitable time for determining the optical spectrum of mud filtrate in a fluid drawn from a formation may be determined from optical data, such as described above, other measurements could also or instead be used. Examples of such other measurements include gas-to-oil ratio, fluid phase fractions, or hydrocarbon composition. Further, in one embodiment the mud filtrate could be segregated within the tool from other components of the fluid drawn from the formation for measurement of the mud filtrate optical spectrum.

With reference again to FIG. 7, the downhole tool can be calibrated within the well (block 186) based on the determined mud filtrate spectrum. In at least some embodiments, the determined mud filtrate spectra are used to calibrate the downhole tool (e.g., optical fluid analyzers and other downhole fluid analysis sensors) to oil-based mud filtrate at in-situ conditions in real-time. The in-situ calibration can also or instead be based on other characteristics determined through downhole fluid analysis.

After this in-situ calibration, the downhole tool can be used to perform additional downhole fluid analysis (block 188). This subsequent analysis can be performed at the same measurement station at which the formation fluid was drawn in block 182 or at other measurement stations. In certain embodiments, an optical fluid analyzer (e.g., fluid analyzer 72) is calibrated in block 186 and the subsequent analysis includes using the optical fluid analyzer to measure an optical spectrum of a formation fluid and to classify a hydrocarbon fluid and determine mud filtrate contamination of the hydrocarbon fluid.

In some embodiments, calibration of the downhole tool based on mud filtrate spectra determined in-situ (or using the determined mud filtrate spectra in some other way for subsequent fluid analysis) can be based on the cumulative mud filtrate spectra or on a filtered set of the mud filtrate spectra. Additionally, the calibration can be based on a representative mud filtrate spectrum determined from a cumulative or filtered set of mud filtrate spectra. One example of a process for determining and using such a representative spectrum is generally represented by flow chart 194 in FIG. 11. In this embodiment, mud filtrate spectra obtained in-situ at one or more measurement stations are compared to one another (block 196). This comparison is visually represented by stacking multiple mud filtrate spectra on a shared plot in FIG. 12. This graph shows just three mud filtrate spectra for the sake of clarity, but any desired number of mud filtrate spectra can be compared in block 196.

Comparing the mud filtrate spectra enables the identification and removal of outliers (block 198) as well as other filtering (e.g., zoning). In some embodiments, additional comparisons with other downhole fluid analysis measurements can also be made, such as for filtering and quality control purposes. The process further includes determining a representative mud filtrate spectrum (block 200) from the determined mud filtrate spectra. Although the representative mud filtrate spectrum is determined from the filtered mud filtrate spectra (e.g., after removal of outliers) in some embodiments, in other instances the representative mud filtrate spectrum could be determined from the unfiltered set of determined mud filtrate spectra. The representative mud filtrate spectrum could be determined in any suitable manner, such as by using an average of the determined mud filtrate spectra (with or without first removing the outliers) or using an average of a subset of the determined mud filtrate spectra, such as an average of determined mud filtrate spectra having a particular characteristic (e.g., in a common zone). Additionally, medians or trimmed means could be used instead of averages. Still further, the representative mud filtrate spectrum could be a spectrum selected from the determined mud filtrate spectra (or a subset of these spectra) based on any desired criteria, such as selecting the spectrum that has the lowest variance from an average or trimmed mean of the considered spectra. The representative mud filtrate spectrum can then be used to inform subsequent downhole fluid analysis (block 202), such as by using the representative mud filtrate spectrum to calibrate the downhole tool.

Figure 11:
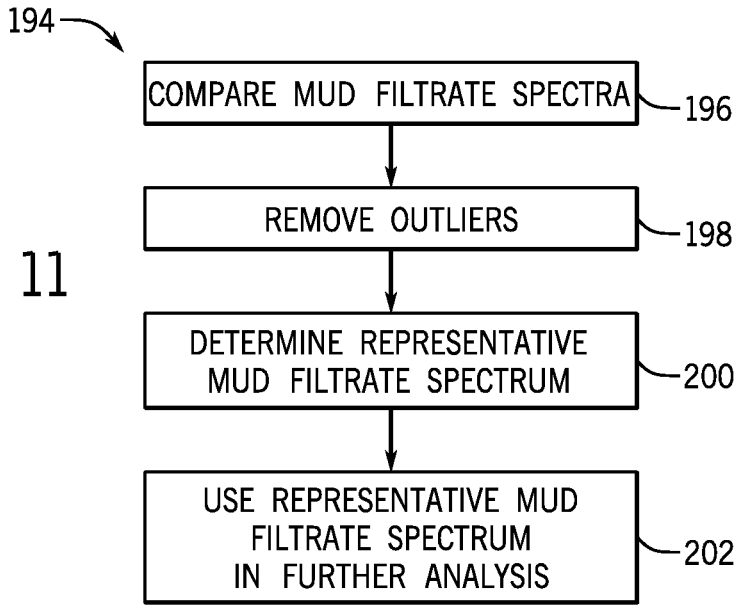
FIG. 11 is a flow chart for comparing mud filtrate spectra and determining a representative mud filtrate spectrum for use in further fluid analysis in accordance with one embodiment.
Figure 12:
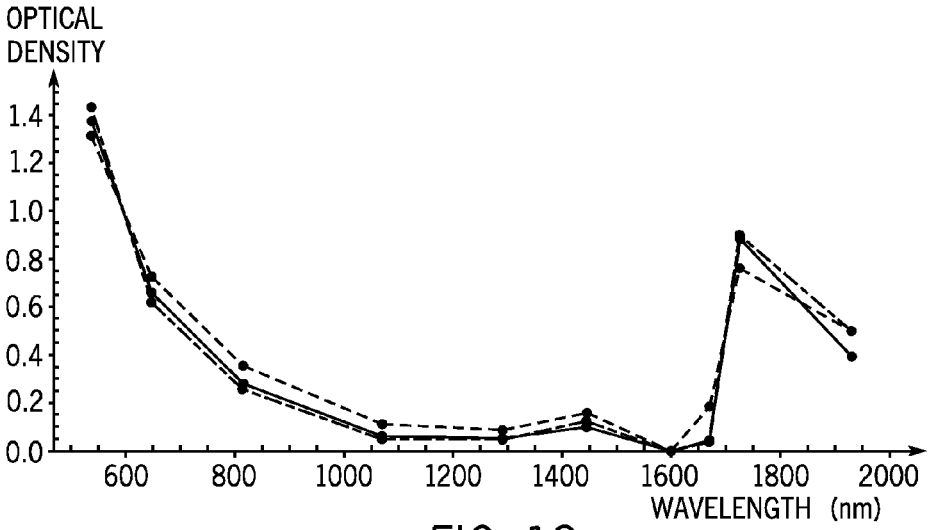
FIG. 12 is a graph with mud filtrate spectra stacked on a common plot to represent the comparison of the various mud filtrate spectra in accordance with one embodiment.
Figure 13:
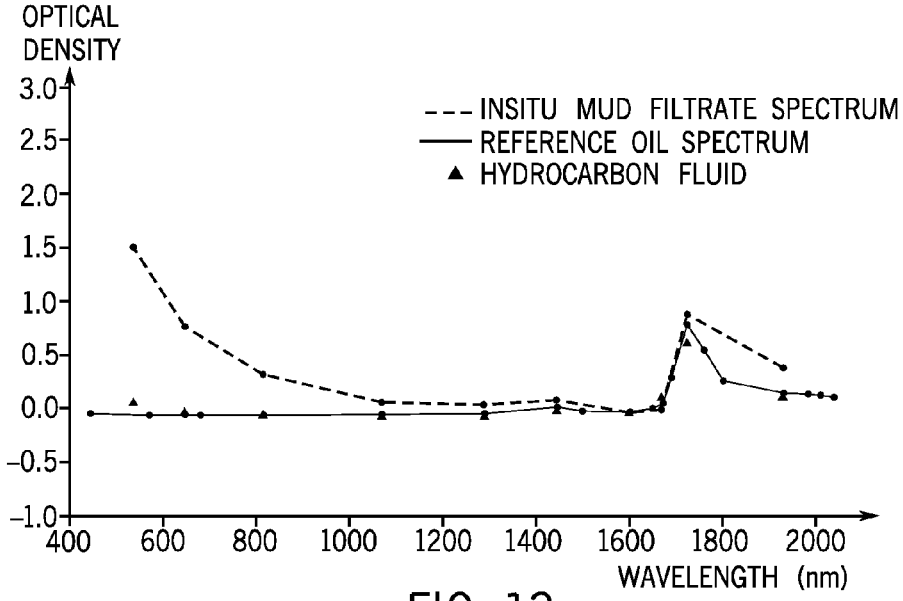
FIG. 13 is a graph comparing a representative mud filtrate spectrum, a spectrum of a hydrocarbon fluid drawn from a formation, and a spectrum of a hydraulic fluid used in a surface calibration, each determined with a fluid analyzer, in accordance with one embodiment.

A comparison of an in-situ mud filtrate spectrum (such as the representative mud filtrate spectrum determined in block 200 of FIG. 11) with the reference oil spectrum of FIG. 8 and an optical spectrum of an in-situ hydrocarbon fluid is shown in the graph of FIG. 13. It will be appreciated that the mud filtrate spectra measurements may be used to improve contamination analysis and estimation of the mud filtrate and as inputs to improve the accuracy of contamination monitoring filtrate correction techniques and for any corrections applied to optical density measurements for advanced downhole fluid analysis applications. In addition, once the mud filtrate response has been calibrated in-situ, the filtrate spectra can also be used to improve identification of the formation fluid optical density response. For example, the use of mud filtrate spectra determined in-situ may enable earlier identification of hydrocarbon presence and earlier measurement of contamination in subsequent downhole fluid analysis.

Various processes disclosed herein, including those generally represented by flow charts 160, 176, and 194, can be carried out with any suitable devices or systems, such as the controller 100 in connection with a downhole tool (e.g., LWD module 44 or additional module 48 of FIG. 1, or fluid sampling tool 62 of FIG. 2). These suitable devices and systems can use algorithms, executable code, lookup tables, and the like (all of which may be stored in a suitable memory device, such as non-volatile memory 126) to carry out the functionality described above. Also, in at least some embodiments the downhole fluid analysis and the in-situ calibration of the downhole tool may be performed in substantially real time without removing fluid samples from the well 14.

While certain embodiments have been described above as using downhole fluid analysis to determine optical spectra of mud filtrate and then using the determined mud filtrate optical spectra to inform further analysis, other characteristics (e.g., composition, compressibility, viscosity, or density) of mud filtrate can also or instead be determined and used to inform further analysis. These other characteristics can be used to calibrate sensors, such as generally described above with respect to optical spectra and flow chart 176. Additionally, the measured characteristics can be compared and filtered as discussed above with respect to optical spectra and flow chart 194. It is further noted that certain characteristics of the mud filtrate, such as density and compressibility, can vary based on temperature and pressure. In some embodiments, temperature and pressure of fluid drawn from a formation can be measured in-situ (e.g., with sensors 106) and used to make adjustments to mud filtrate density, compressibility, or other determined characteristics.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method comprising:

performing downhole fluid analysis of formation fluid drawn at a wellbore measurement station;

determining a characteristic of mud filtrate in the formation fluid drawn at the wellbore measurement station; and performing downhole fluid analysis of formation fluid drawn at an additional wellbore measurement station, wherein performing the downhole fluid analysis of formation fluid drawn at the additional wellbore measurement station includes using the determined characteristic of the mud filtrate in the formation fluid drawn at the wellbore measurement station, wherein (1) the wellbore measurement station is in a water zone of a well and the additional wellbore measurement station is in an oil zone of the well, or (2) the wellbore measurement station and the additional wellbore measurement station are in different wells.

2. The method of claim 1, wherein determining the characteristic of the mud filtrate includes determining at least one of an optical spectrum, density, viscosity, compressibility, or composition of the mud filtrate.

3. A method comprising:

performing downhole fluid analysis of formation fluid drawn at a wellbore measurement station;

determining an optical spectrum of mud filtrate in the formation fluid drawn at the wellbore measurement station;

calibrating an optical fluid analyzer using the determined optical spectrum of the mud filtrate in the formation fluid drawn at the wellbore measurement station; and using the calibrated optical fluid analyzer to measure an optical spectrum of the formation fluid drawn at an additional wellbore measurement station;

identifying or determining contamination of a hydrocarbon fluid in the formation fluid drawn at the additional wellbore measurement station.

4. A method comprising:

measuring, with a downhole tool positioned within a wellbore, a plurality of sets of optical densities of formation fluid to multiple wavelengths of electromagnetic radiation;

calibrating the downhole tool within the wellbore based on the plurality of sets of measured optical densities, including filtering the compared sets or determining a representative mud filtrate spectrum from the compared sets and using the determined representative mud filtrate spectrum to calibrate the downhole tool; and measuring, with the calibrated downhole tool, an additional set of optical densities of formation fluid to multiple wavelengths of electromagnetic radiation.

5. The method of claim 4, wherein calibrating the downhole tool within the wellbore based on the plurality of sets of measured optical densities includes comparing at least some sets of the plurality of sets to one another.

6. A method comprising:

performing downhole fluid analysis of formation fluid drawn at a wellbore measurement station;

determining a characteristic of mud filtrate in the formation fluid drawn at the wellbore measurement station;

performing downhole fluid analysis of formation fluid drawn at an additional wellbore measurement station, wherein performing the downhole fluid analysis of formation fluid drawn at the additional wellbore measurement station includes using the determined characteristic of the mud filtrate in the formation fluid drawn at the wellbore measurement station; and extrapolating a mud filtrate optical spectrum of the formation fluid drawn at the additional wellbore measurement station from the determined optical spectra mud filtrate in the formation fluid drawn at the additional wellbore measurement station.

7. The method of claim 6, comprising:

performing downhole fluid analysis of formation fluids drawn at a plurality of wellbore measurement stations; and determining optical spectra of mud filtrate in the formation fluids drawn at the plurality of wellbore measurement stations.

8. The method of claim 7, comprising extrapolating a mud filtrate optical spectrum of the formation fluid drawn at the additional wellbore measurement station from the determined optical spectra of mud filtrate in the formation fluids drawn at the plurality of wellbore measurement stations.

9. The method of claim 8, wherein extrapolating the mud filtrate optical spectrum of the formation fluid drawn at the additional wellbore measurement station includes filtering the determined optical spectra of mud filtrate in the formation fluids drawn at the plurality of wellbore measurement stations and estimating the mud filtrate optical spectrum of the formation fluid drawn at the additional wellbore measurement station from the filtered optical spectra.

10. The method of claim 7, comprising using the determined optical spectra of mud filtrate in the formation fluids drawn at the plurality of wellbore measurement stations to calibrate a sensor of a downhole tool.

* * * * *